US006814627B2

(12) United States Patent
Yamamoto et al.

(10) Patent No.: US 6,814,627 B2
(45) Date of Patent: Nov. 9, 2004

(54) COVER, A JOINT CONNECTOR AND A METHOD FOR MOUNTING A JOINT CONNECTOR

(75) Inventors: Kazuhiro Yamamoto, Yokkaichi (JP); Kuniharu Kusumoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/272,350

(22) Filed: Oct. 15, 2002

(65) Prior Publication Data

US 2003/0073352 A1 Apr. 17, 2003

(30) Foreign Application Priority Data

Oct. 16, 2001 (JP) ..... 2001-318153

(51) Int. Cl.[7] ..... H01R 13/502
(52) U.S. Cl. ..... 439/701; 439/149; 439/912
(58) Field of Search ..... 439/135, 148, 439/149, 701, 912, 752

(56) References Cited

U.S. PATENT DOCUMENTS 5,556,291 A * 9/1996 Ito ..... 439/189
5,556,301 A * 9/1996 Chishima et al. ..... 439/507
5,573,430 A * 11/1996 Hatagishi ..... 439/701
5,997,362 A * 12/1999 Hatagishi et al. ..... 439/701
6,068,522 A * 5/2000 Aoyama et al. ..... 439/701
6,146,200 A 11/2000 Ito et al.
6,171,140 B1 * 1/2001 Anbo et al. ..... 439/516
6,193,529 B1 2/2001 Kimura
6,358,098 B1 3/2002 Wakata
6,589,079 B2 * 7/2003 Kashiyama et al. ..... 439/595
6,592,410 B2 * 7/2003 Yoshida et al. ..... 439/701

FOREIGN PATENT DOCUMENTS

GB 2 271 475 4/1994

* cited by examiner

*Primary Examiner*—Thanh-Tam Le
(74) *Attorney, Agent, or Firm*—Gerald E. Hespos; Anthony J. Casella

(57) ABSTRACT

A joint connector (JC) has housings (20) with chambers (21) therein. Insertion openings (22) and outlets (23) extend into each chamber (21) at the front end of the housing (20). Terminal fittings (10) are inserted into chambers (21) so that joints (16) of the terminal fittings (10) project forward through outlets (23). A cover (60) is detachably mounted on each housing (20) to protect the joints (16). Insertion holes (72) and insertion paths (73) are formed in the cover (60) and align with the insertion openings (22) of the housing (20). A probe (80) can be inserted through the insertion holes (72) and the insertion paths (73) for contacting the terminal fittings (10) so that an electrical connection test can be performed.

11 Claims, 17 Drawing Sheets

COVER, A JOINT CONNECTOR AND A METHOD FOR MOUNTING A JOINT CONNECTOR

BACKGROUND OF THE INVENTION

1. Field of the Invention

The present invention relates to a cover, a joint connector and to a method for mounting a joint connector.

2. Description of the Related Art

U.S. Pat. No. 6,358,098 and FIG. 18 herein show a joint connector for connecting wires, such as ground wires, in a common circuitry. The joint connector of FIG. 18 has a plurality of housings 1 and chambers 2 in each housing 1. The chambers 2 extend in forward and backward in the housing 1 and are arranged transversely. Terminal fittings 3 are accommodated in the chambers 2, and a wire 4 is connected to a wire-connecting portion 5 of each terminal fitting 3. Each terminal fitting 3 also has a terminal connecting portion 6 for receiving another terminal fitting 3, and a tab-shaped joint 7 that extends forward from the terminal connecting portion 6.

The terminal fittings 3 are accommodated in the chambers 2 so that the joints 7 projects through front openings 8 of the housing 1. The joints 7 then are bent twice at right angles and the respective housings 1 are joined together one over another by being slid in forward and backward directions. As a result, as shown in FIG. 19, the joints 7 in each housing 1 are introduced from the front into the chambers 2 of the housing 1 located right above and engage the terminal connecting portions 6 of the terminal fittings 3 in the chambers 2 to connect upper and lower terminal fittings 3.

An electrical connection test is performed immediately before the respective housings 1 are joined one over another, and there is a possibility of remounting the terminal fittings 3 based on the results of the electrical connection test. The terminal fittings 3 cannot be removed and remounted after the joints 7 are bent. Thus, the joint connector is handled considerably while the joints 7 of the terminal fittings 3 project forward from the housings 1, and there is a danger that a collision with external matter will deform the joints 7. Accordingly, a countermeasure has been an urgent necessity.

The present invention was completed in view of the above problem and an object thereof is to improve the operability of joint connectors.

SUMMARY OF THE INVENTION

The invention relates to a cover for a joint connector having a plurality of housings and at least one terminal-accommodating chamber in each housing. Terminal fittings for the joint are accommodated in the corresponding chambers and have joints that project through front openings of the chambers. The cover is detachably mountable on each housing to cover the joints of the terminal fittings that project through front openings of the chambers. The cover protects the joints of the terminal fittings from collision with external matter.

Insertion holes may be formed in the cover for permitting an electrical connection-testing device to be inserted into electrical contact with the terminal fittings. Thus, an electrical connection test can be conducted while the joints are aligned straight and protected, and the terminal fitting can be reinserted easily if necessary.

First and second walls of the cover preferably are formed substantially continuously with each insertion hole. An insertion path is defined between the first and second walls for permitting the insertion of the electrical connection-testing device and for preventing the electrical connection-testing device from shaking toward and away from the terminal fitting. Thus, the electrical connection-testing device cannot collide with the joint.

The projecting joint of each terminal fitting is spaced laterally from the first and second walls, and an end of the wall outside of which the joint is to be located has a guide surface for guiding the joint to a position outside this wall. The joints are guided to the outside of the specified wall by the guide surface both if the cover is mounted after the terminal fittings are inserted into the chambers and if the terminal fittings are inserted into the chambers after the cover is mounted on the housing. This avoids problems such as the deformation of the joints caused by collision with the wall and a hindrance to the entrance of the electrical connection-testing device by the joints that have entered the insertion paths.

Third and fourth walls preferably are formed substantially continuously with each insertion hole and an insertion path is defined between the third and fourth walls for permitting the insertion of the electrical connection testing device while preventing it from shaking transversely. Thus, the electrical connection-testing device can be guided precisely to a specified contact portion of the terminal fitting, such as the terminal connecting portion.

The invention also relates to a joint connector. The connector comprises a plurality of housings. Chambers extend in forward and backward directions in each housing and are arranged substantially side by side. Terminal fittings are disposed in the respective housings. Each terminal fitting preferably comprises a wire connecting portion for connection with an end of a wire and a terminal connecting portion for connection with another terminal fitting. Each terminal fitting also has a joint that extends forward from the terminal connecting portion. The terminal fittings can be mounted in the chambers while the joints projecting through front openings of the chambers. The covers are mounted detachably on the respective housings to cover the joints that project through the front openings of the chambers. Thus, the cover protects the joints from collision with external matter. The cover may be formed with insertion holes for permitting the insertion of an electrical testing probe and the electrical contact thereof with the terminal fittings.

The connector may further comprise a retainer for locking the terminal fittings in the housing. The retainer is mountable on each housing, and each cover is formed with an aperture through which the retainer can be mounted, manipulated and/or operated. The ability to access the retainer while the cover is mounted on the connector housing improves operability.

Each cover preferably comprises a resilient lock for engaging the corresponding housing. Thus, the cover can be locked firmly by the lock and can be unlocked without plastically deforming the lock.

A guide may be provided on at least one side surface of each housing. The guides are aligned when the housings are joined one over another, and a shutter can be mounted slideably in the guides to cover the front surfaces of the joined housings. Each guide may also engage the resilient lock of the corresponding cover. The dual function of the guides simplifies the construction of the joint connector.

The invention also relates to a method of assembling a joint connector. The method comprises providing a plurality of housings having one or more chambers. The method then comprises accommodating terminal fittings for the joint in the corresponding chambers while allowing a tab-shaped joints of at least part of the terminal fittings to project through front openings of the chambers. The method then comprises detachably mounting a cover on each housing to cover the joints of the terminal fittings projecting through the front openings of the chambers.

The step of mounting the cover may be before or after the step of mounting the terminal fittings in the chambers.

The method may further comprise removing the cover from the respective housing, bending the joints of the terminal fittings so that they project substantially backward, and joining two or more housings so as to join the joint of one terminal fitting in one housing with a corresponding terminal fitting of the other housing.

Preferably, the method further comprises the step of inserting an electrical connection testing device into one or more insertion holes to bring it into the electrical contact with the terminal fittings and performing an electrical connection test.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 14:
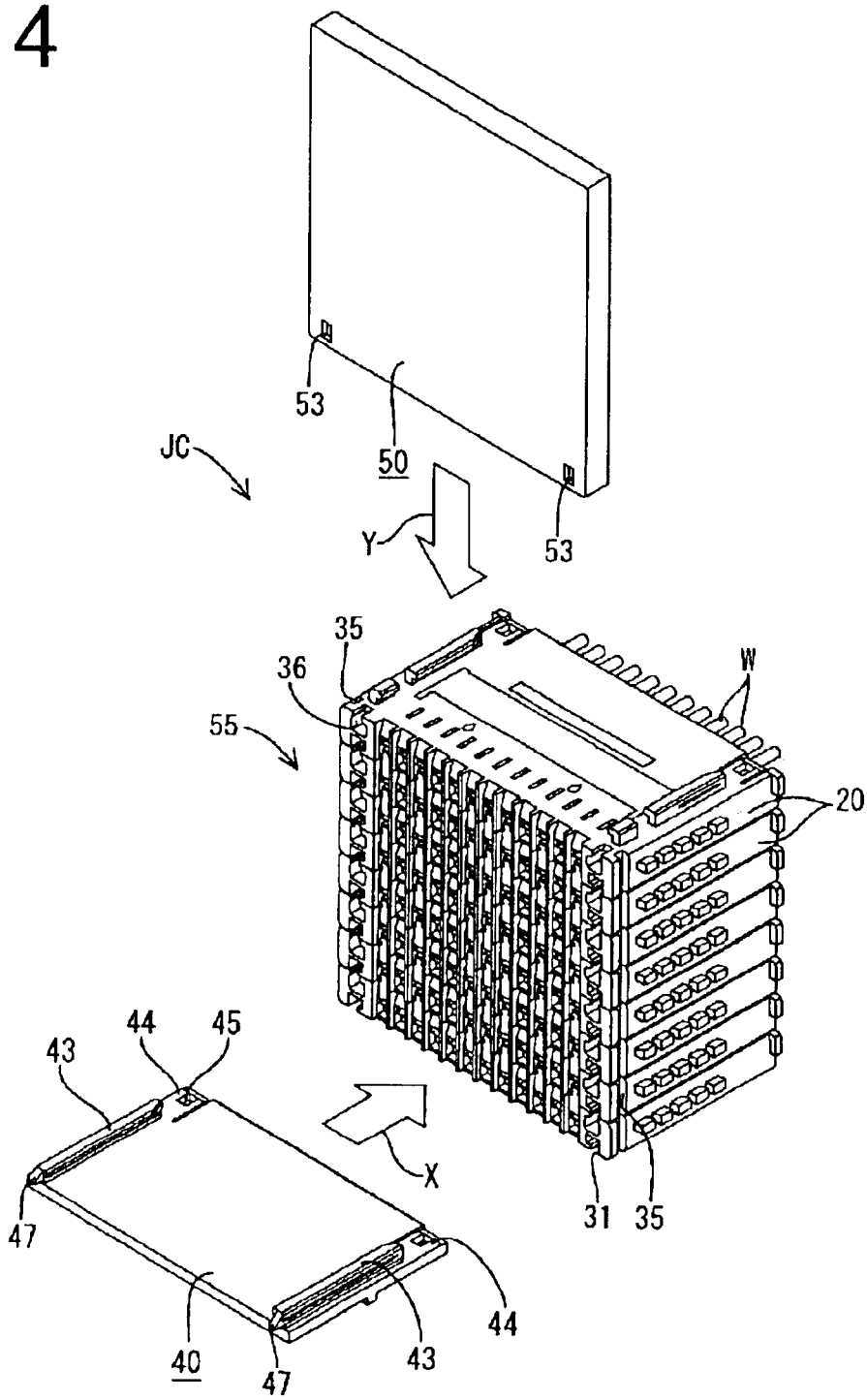
FIG. 14 is a perspective view showing an operation of mounting a fixing member and a shutter.

A joint connector according to the invention is identified by JC in FIG. 14. The joint connector JC includes a block 55 formed by arranging a plurality housings 20 one over another. A fixing member 40 is mounted on the bottom surface of the block 55 and a shutter 50 is mounted on the front mating surface of the block 55.

Figure 1:
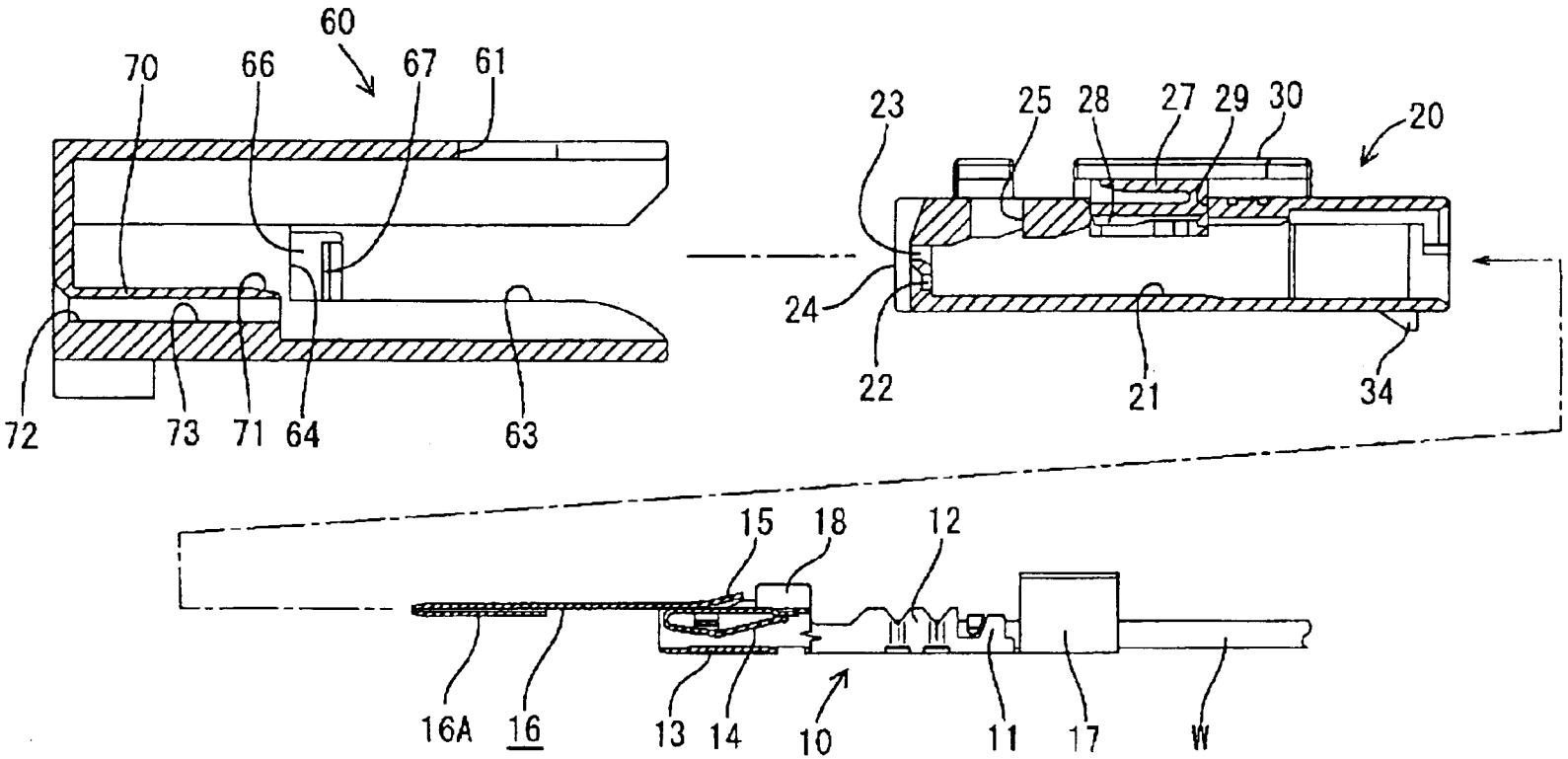
FIG. 1 is an exploded longitudinal section showing a state before terminal fittings and a cover are mounted into and on a connector housing according to one embodiment of the invention.

Each housing 20 of the joint connector includes at least one terminal fitting 10 as shown in FIG. 1. An insulation barrel 11 is formed at the rear end of the terminal fitting 10 and is configured for crimped, bent or folded connection with the insulation coating of a wire W. An insulation-displacement portion 12 is adjacent and before the insulation barrel 11 and is configured for connection with the end of the wire W by insulation displacement. A terminal connecting portion 13 is provided before the insulation-displacement portion 12 and is configured for connection with another terminal fitting 10. The terminal connecting portion 13 is substantially in the form of a rectangular tube with open front and rear ends. A resilient contact piece 14 is folded in at the front end of the terminal connecting portion 13 into a substantially triangular or pointed shape adjacent the inner wall of a double-wall ceiling. A resiliently deformable metal lock 15 is formed at an outer wall of the ceiling and extends obliquely up to the back.

A tab-shaped joint 16 extends forward from the front edge of the outer wall of the ceiling of the terminal-connecting portion 13. Approximately the rear half of the joint 16 is formed by a single plate. However, approximately the front half 16A of the joint 16 is of double thickness by folding the plate together at one lateral side.

Figure 2:
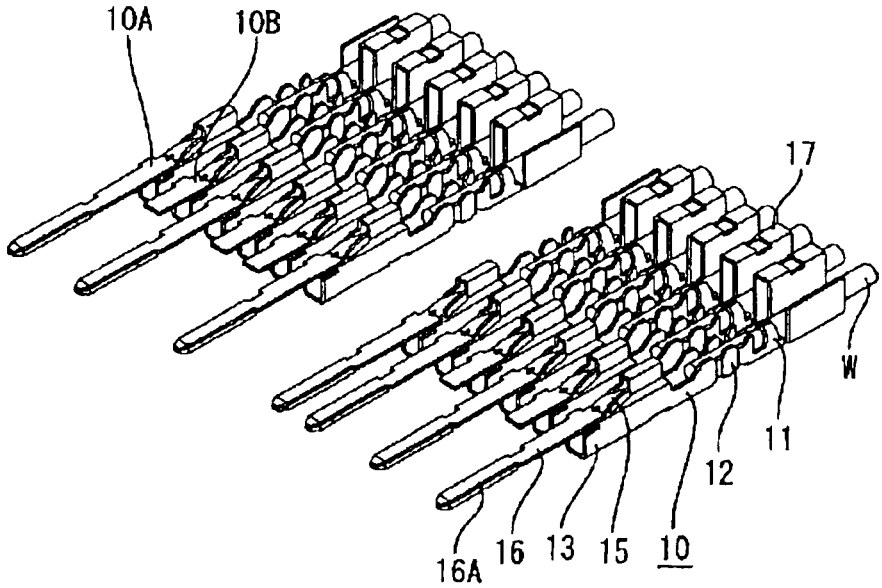
FIG. 2 is a perspective view of the terminal fittings.

The terminal fittings 10 are produced in series on a carrier that is deformed into a wavy chain 17 at a final stage of the production process. FIG. 2 shows a chained terminal with six terminal fittings 10 connected via the chain 17. The terminal fittings 10 selectively take forms 10A that have the joint 16 and forms 10B that have the joints 16 cut off.

Figure 3:
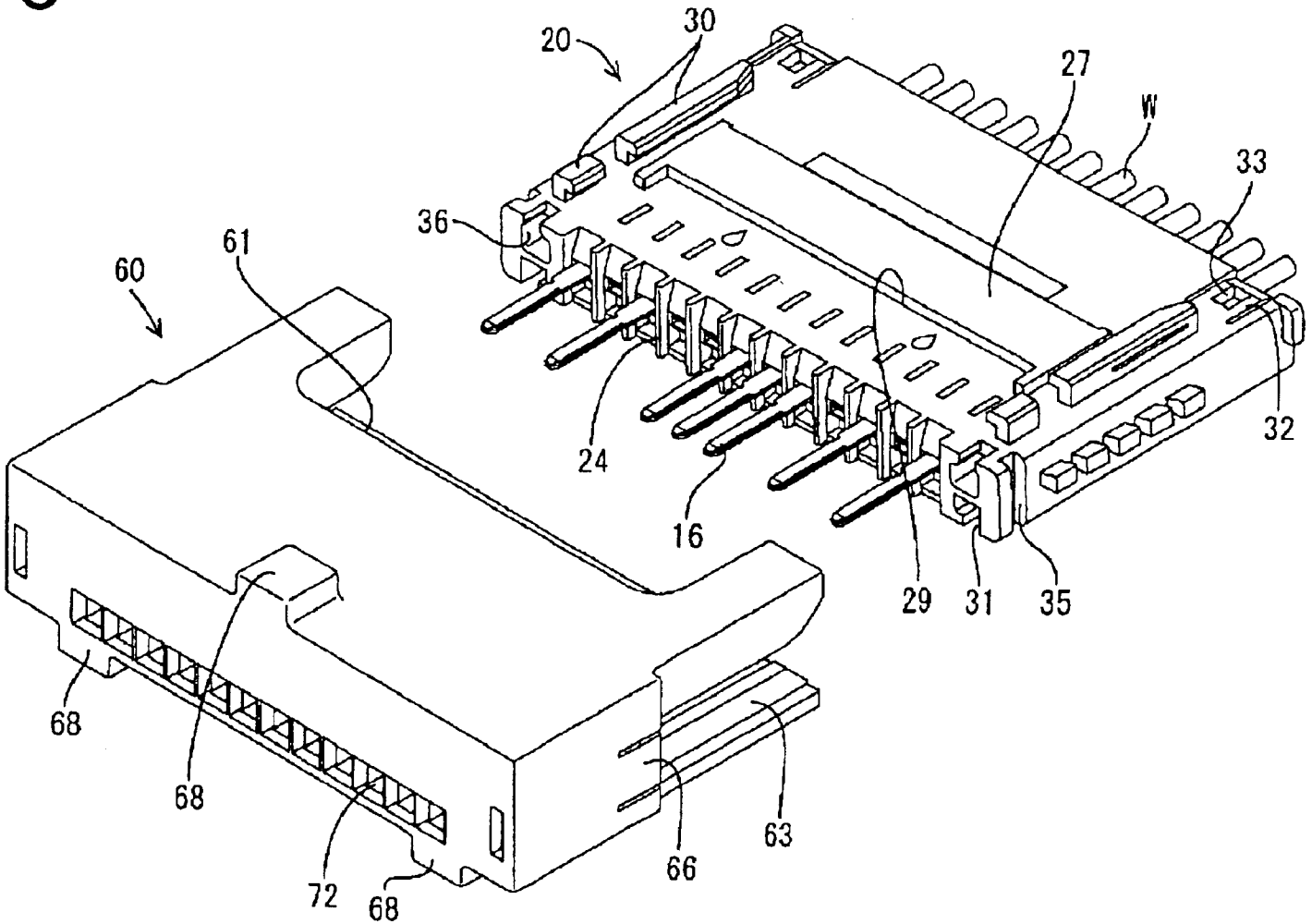
FIG. 3 is a perspective view showing a state where the cover is mounted.

The housing 20 is formed e.g. of a synthetic resin and has a substantially flat block shape, as shown in FIGS. 1 and 3. Chambers 21 are arranged transversely across the housing 20 so that each chamber extends from the front to the rear of the housing 20. The terminal fittings 10 are inserted into the chambers 21 through their rear openings.

The front surface of each chamber 21 is formed with an insertion opening 22 through which the joint 16 of another terminal fitting 10 is insertable for engagement with the terminal connecting portion 13 of the terminal fitting 10 accommodated therein. The front surface of each chamber 21 also has an outlet 23 formed above the insertion opening 22 for enabling the joint 16 of the terminal fitting 10 accommodated in the chamber 21 to project forward. Further, substantially vertical partition walls 24 project from the front surface of the housing 20 for partitioning the respective chambers 21.

The rear openings of the chambers 21 communicate with each other so that the chains 17 of the terminal fittings 10 can be connected with each other. A locking hole 25 is formed near the front end of the ceiling of each chamber 21 and in a position for receiving the metal lock 15 when the terminal fitting 10 is positioned properly in the chamber 21.

Figure 13:
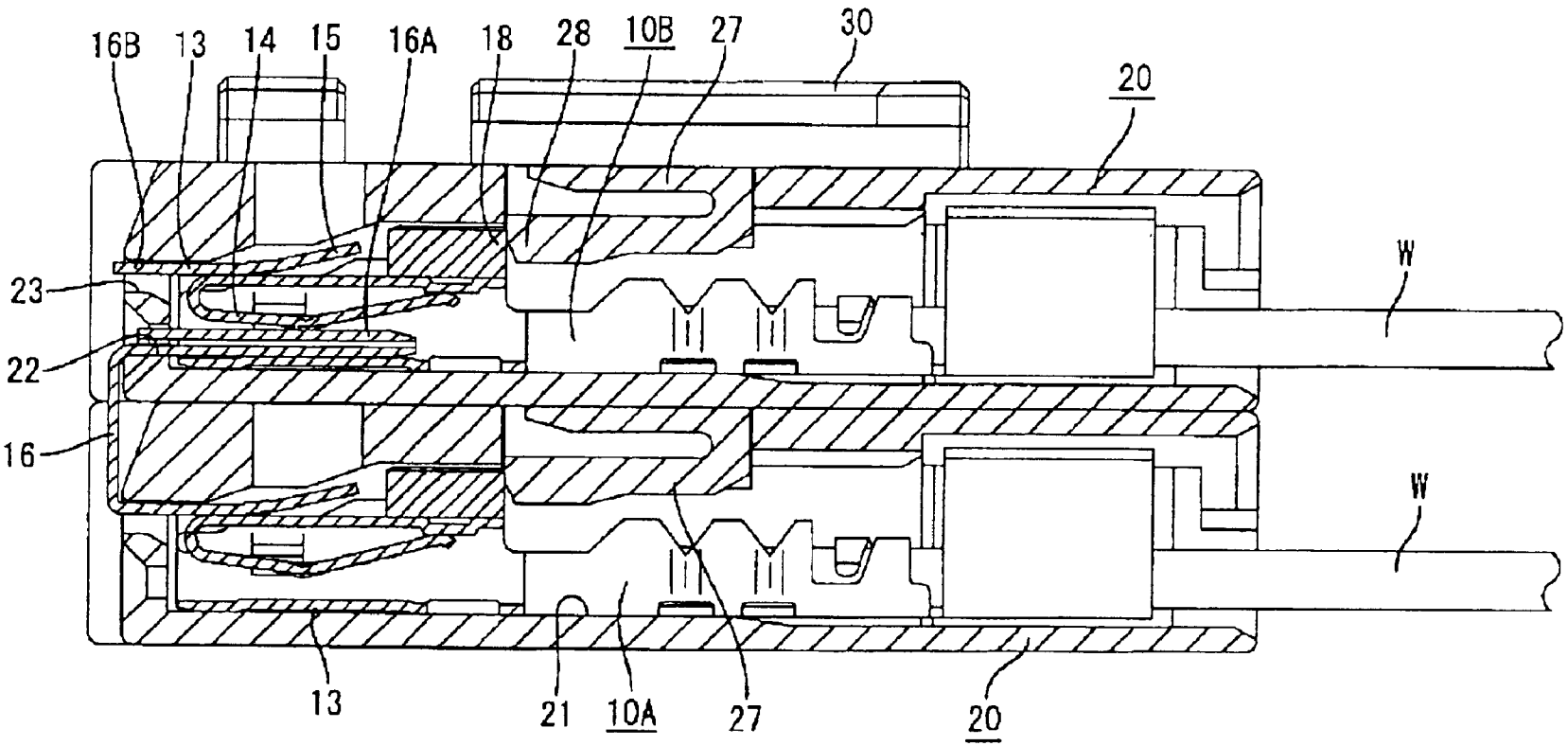
FIG. 13 is a longitudinal section showing a state where the connector housings are joined by being placed one over the other.

A retainer insertion opening 29 is formed in the upper surface of the housing 20 and communicates with the chambers 21. A retainer 27 can be inserted into the retainer insertion opening 29 and held at a partial locking position or a full locking position. The retainer 27 has locks 28 that are retracted above the chambers 21 when the retainer is in the partial locking position, as shown in FIG. 1. Thus, the terminal fittings 10 can be inserted into and withdrawn from the chambers 21 when the retainer 27 is at the partial locking position. The retainer 27 is substantially flush with the upper surface of the housing 20, as shown in FIG. 13, when the retainer 27 is in the full locking position. At this full locking position, the locks 28 project into the chambers 21 to engage engaging portions 18 of the terminal fittings 10 and to retain the terminal fittings 10 in the chambers 21.

Figure 8:
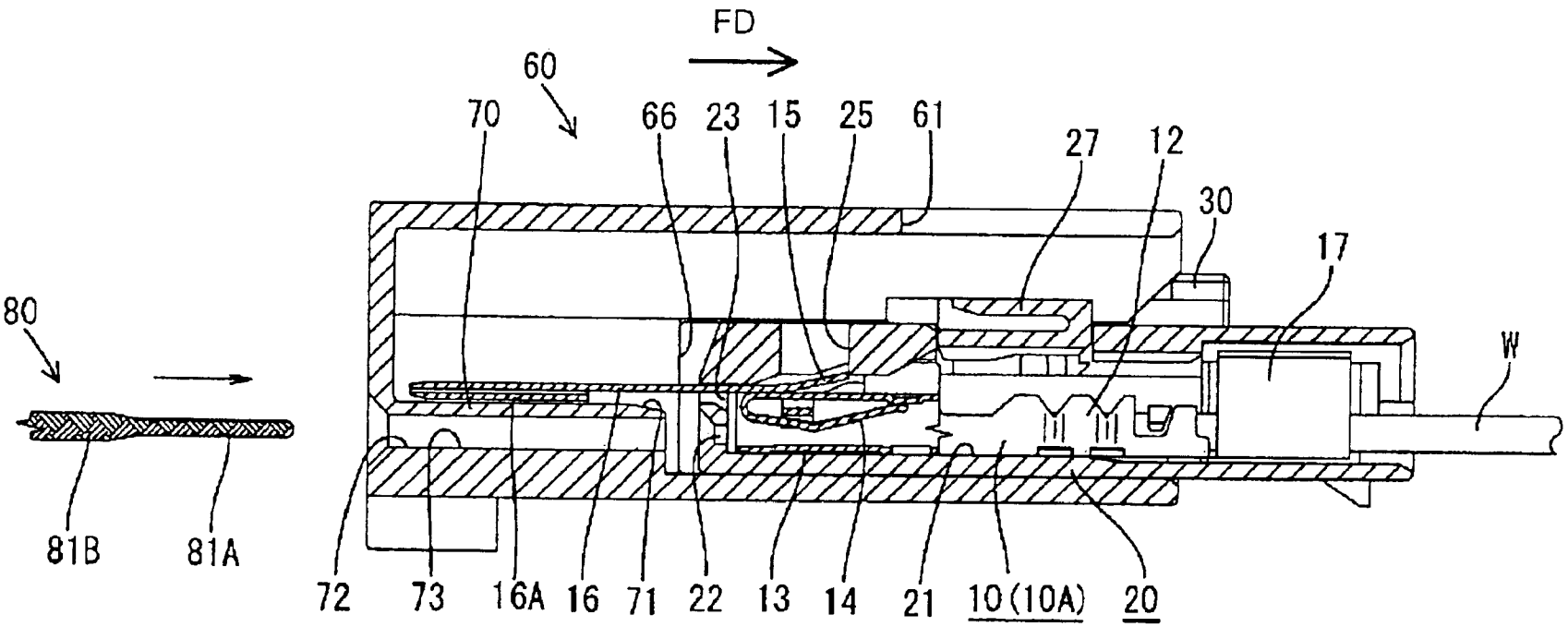
FIG. 8 is a longitudinal section showing a state before an electrical connection test.

The terminal fitting 10 is inserted into the corresponding chamber 21 from behind while the retainer 27 is at the partial locking position, as shown in FIG. 1. As a result, the terminal fitting 10 pushes and resiliently deforms the metal lock 15 from an intermediate stage on. The metal lock 15 restores and fits into the locking hole 25, as shown in FIG. 8, when the terminal fitting 10 is pushed to bring the terminal connecting portion 13 into contact with the front wall of the chamber 21. Thus, the terminal fitting 10 is locked partly so as not to come out.

At this time, the joint 16 projects forward through the outlet 23 if the terminal fitting 10A still has the joint 16, whereas a cut portion 16B stays near the outlet 23, as shown at the upper stage of FIG. 13, if the terminal fitting 10B has the joint 16 cut off.

Opposed left and right hook-shaped ribs 30 are provided on the upper surface of each housing 20, as shown in FIG. 3. The ribs 30 are interrupted at intermediate positions. On the other hand, left and right hook-shaped engaging grooves 31 are formed on the bottom surface of each housing 20 and are closely engageable with the ribs 30. A locking piece 32 formed with a locking hole 33 is provided behind each rib 30 on the upper surface of the housing 20, and projections 34 are formed on the bottom of the housing 20 near the rear end for fitting into the locking holes 33 (see FIG. 1).

Figure 12:
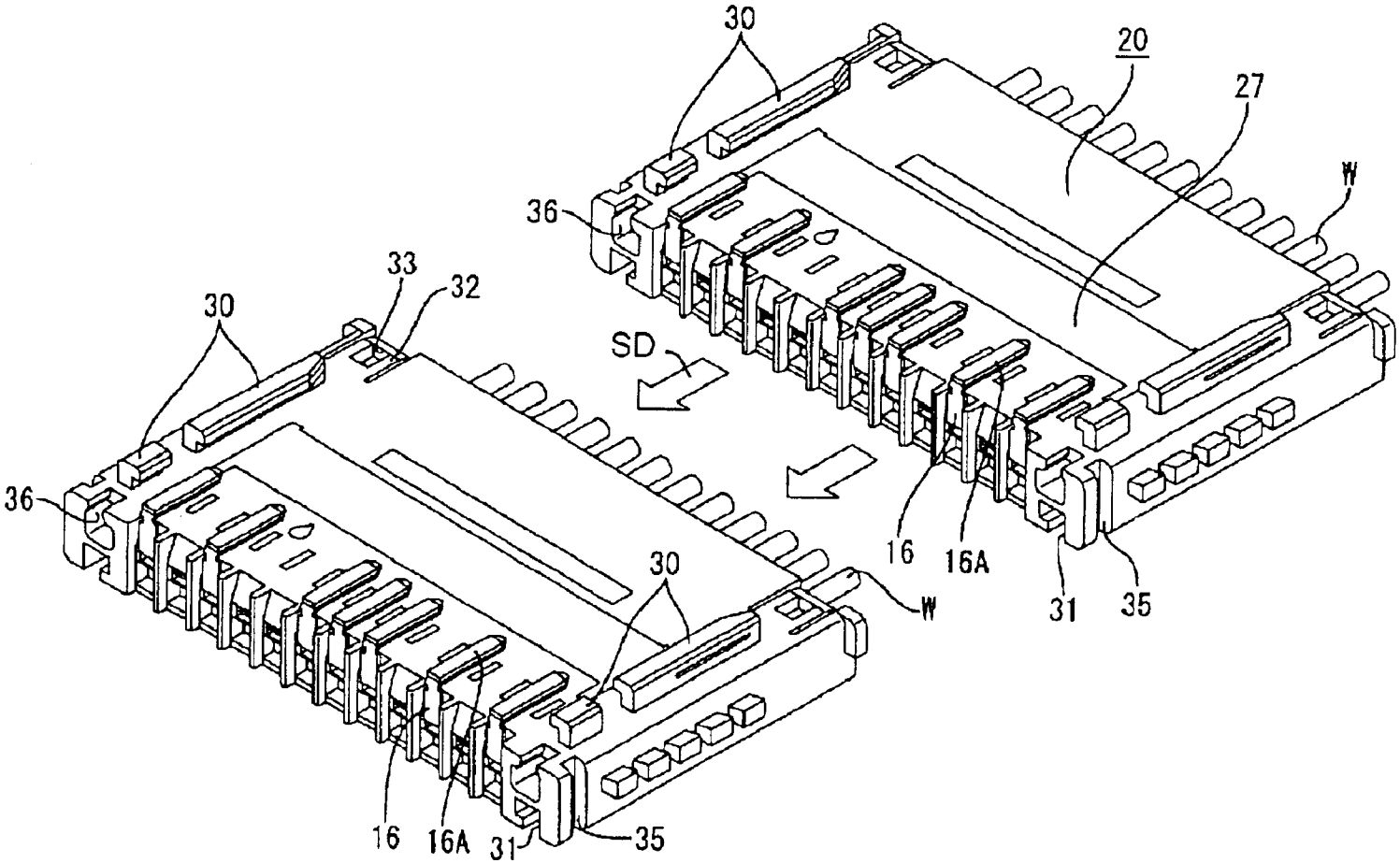
FIG. 12 is a perspective view showing an operation of connecting two connector housings.

Two housings 20 can be joined by aligning the engaging grooves 31 of the upper housing 20 with the ribs 30 of the lower housing 20 and sliding the upper housing 20 in a sliding direction SD as indicated by arrows SD in FIG. 12. Projections 34 at the end of the joint, fit into the locking holes 33 of the locking pieces 32 to inseparably hold the housings 20. Thus, the housings 20 that are to be fitted to each other are placed laterally from each other and slid with respect to each other while coupling the ribs 30 of one housing 20 with the respective engaging groove 31 of the other housing 20 until the locking holes 33 and the projections engage for locking the two housings 20 together.

Figure 15:
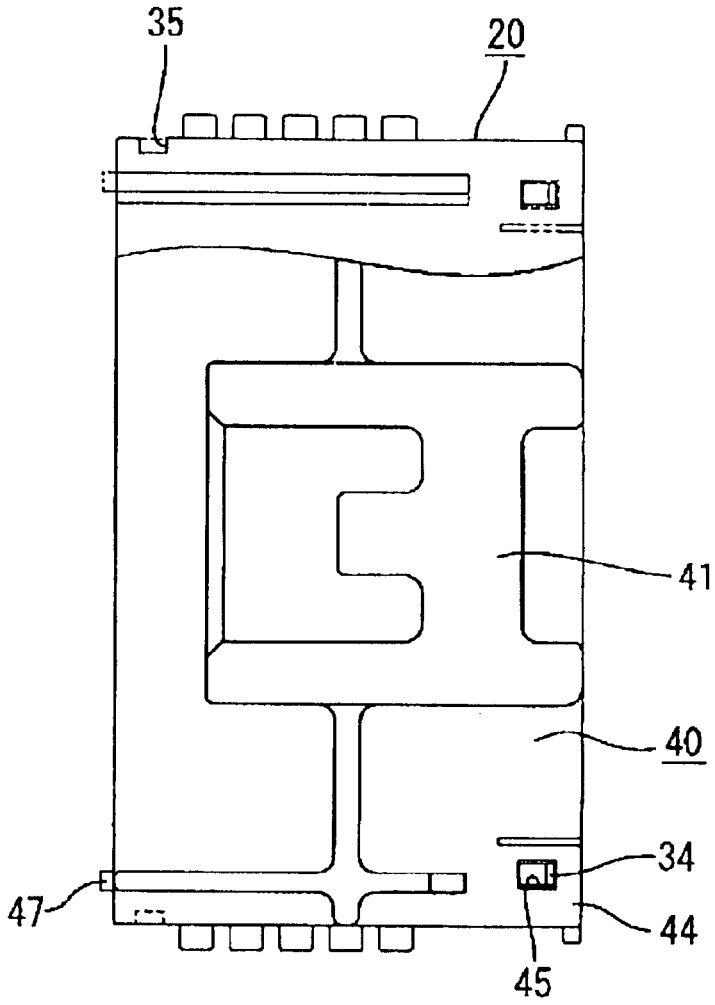
FIG. 15 is a bottom view partly in section showing a state where the fixing member is mounted.

The fixing member 40 is formed e.g. of a synthetic resin and has a substantially rectangular plate with substantially the same external shape as the housing 20 as shown in FIGS. 14 and 15. A cassette lock 41 to be inserted into a mounting portion of a mating member is formed on the bottom surface of the fixing member 40.

Continuous ribs 43 are formed at the opposite sides of the upper surface of the fixing member 40 and have a hooked cross section similar to the ribs 30 of the housings 20. Locking pieces 44 are formed before the ribs 43 with respect to their inserting direction X and are formed with locking holes 45 into which the projections 34 of the connector housing 20 are fittable.

Accordingly, the ribs 43 are aligned with the engaging grooves 31 of the housing 20 and the fixing member 40 is slid to a specified position as indicated by an arrow X in FIG. 14, the projections 34 are at fitted into the locking holes 45 of the locking pieces 44, so that the fixing member 40 is inseparably held while substantially covering the entire bottom surface of the connector housing 20 as shown in FIG. 15.

Figure 16:
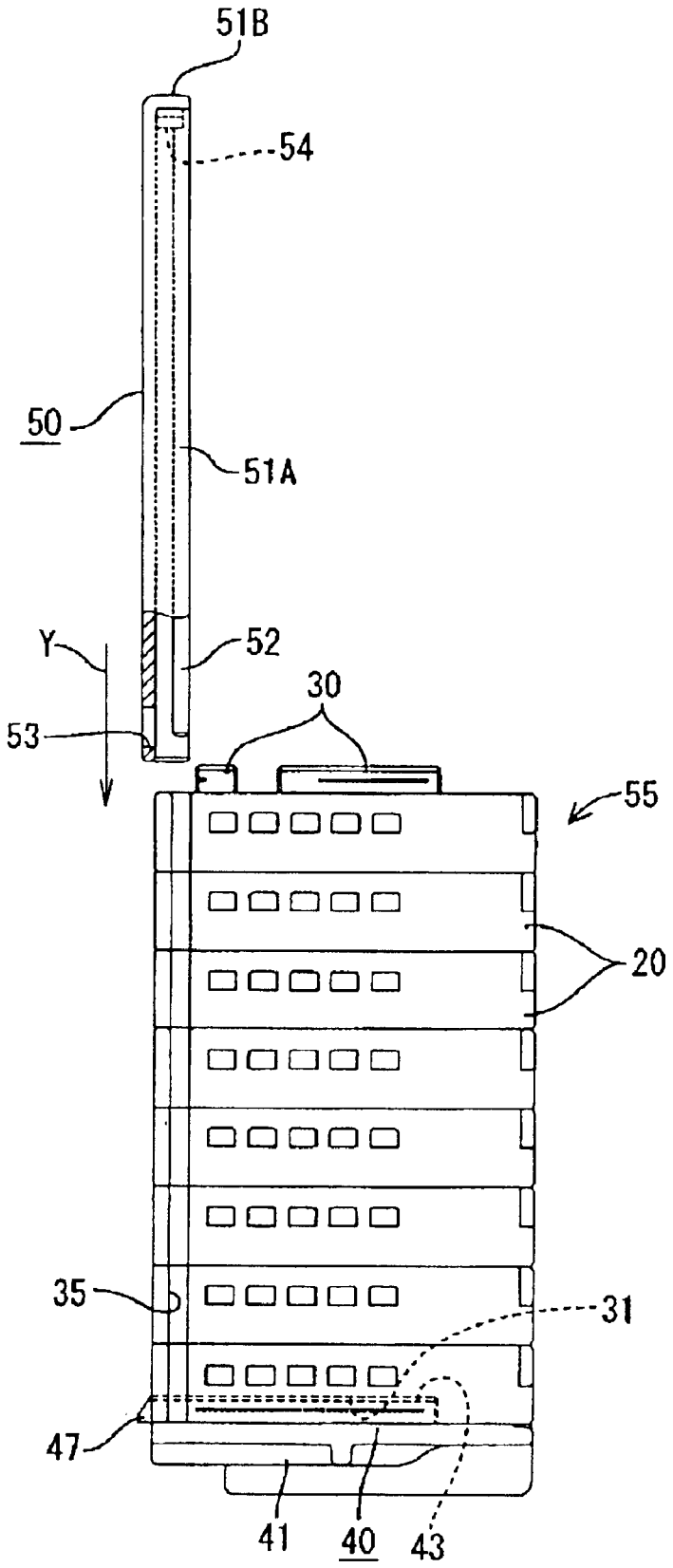
FIG. 16 is a side view partly in section showing the operation of mounting the shutter.

The shutter 50 is a synthetic resin plate slightly larger than the front surface of the block 55, as shown in FIGS. 14 and 16. The shutter 50 has sidewalls 51 at three sides excluding a bottom side, and elongated projections 52 aligned along the mounting direction Y are formed on the inner surfaces of the left and right side walls 51A. On the other hand, vertical guide grooves 35 are formed near the front of the left and right side surfaces of the housings 20. The guide grooves 35 align when the housings 20 are placed one over another into the block 55. Thus, the elongated projections 52 of the shutter 50 can be slid into the guide grooves 35.

Lock holes 53 are formed at the opposite left and right ends of the bottom end of the shutter 50, and the fixing member 40 is formed with lock projections 47 that project from the rear surfaces of the ribs 43 with respect to their inserting direction X for fitting into the lock holes 53.

Engaging projections 54 are formed at the opposite left and right ends of the inner surface of the upper side wall 51B of the shutter 50, and recesses 36 are formed at the opposite left and right ends of the front end of the upper surface of the housings 20 for engaging the engaging projections 54.

Figure 17:
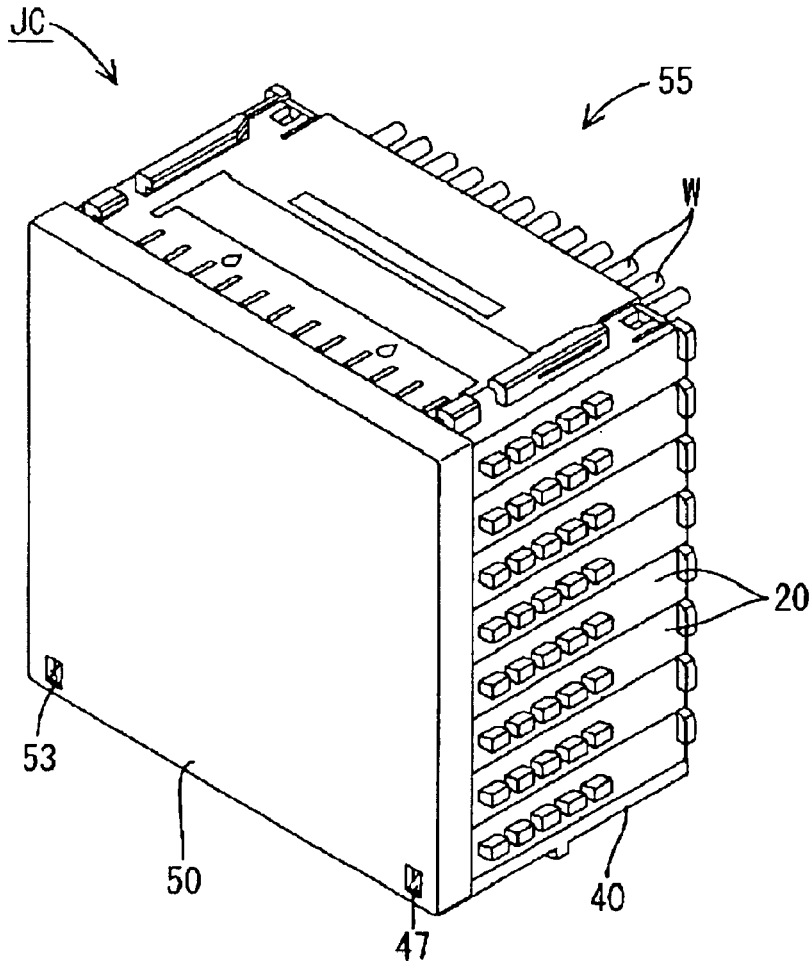
FIG. 17 is a perspective view of a completely assembled joint connector.
Figure 18:
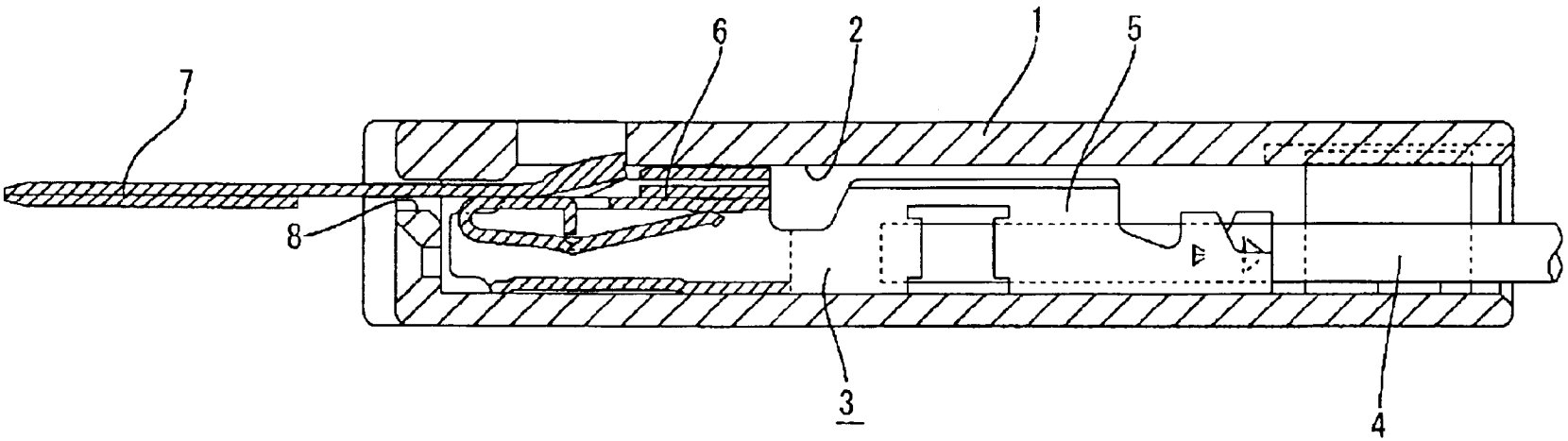
FIG. 18 PRIOR ART
FIG. 18 is a longitudinal section showing a state where terminal fittings are accommodated in a connector housing according to a prior art.
Figure 19:
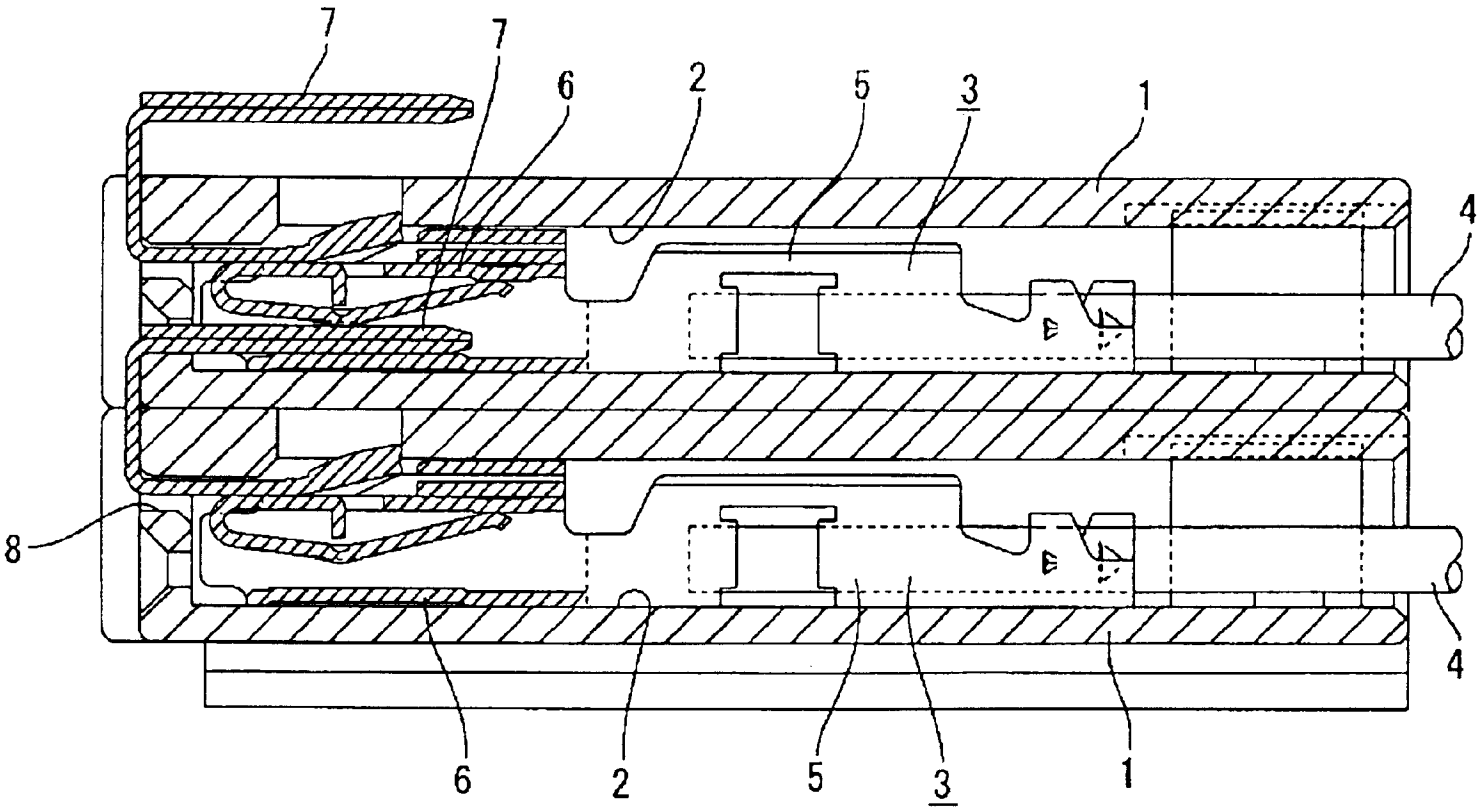
FIG. 19 PRIOR ART
FIG. 19 is a longitudinal section showing a state where two connector housings are placed one over the other.

The fixing member 40 is mounted on the bottom surface of the block 55 and then the shutter 50 is mounted on the block 55 from above as indicated by the arrow Y in FIGS. 14 and 16. Specifically, the shutter 50 is pushed while aligning the elongated projections 52 with the guide grooves 53. The shutter 50 is pushed to a specified depth where the engaging projections 54 fit into the recesses 36, and where the lock projections 47 fit into the lock holes 53. Thus, the shutter 50 is mounted to substantially cover the front surface of the block 55, as shown in FIG. 17.

Figure 10:
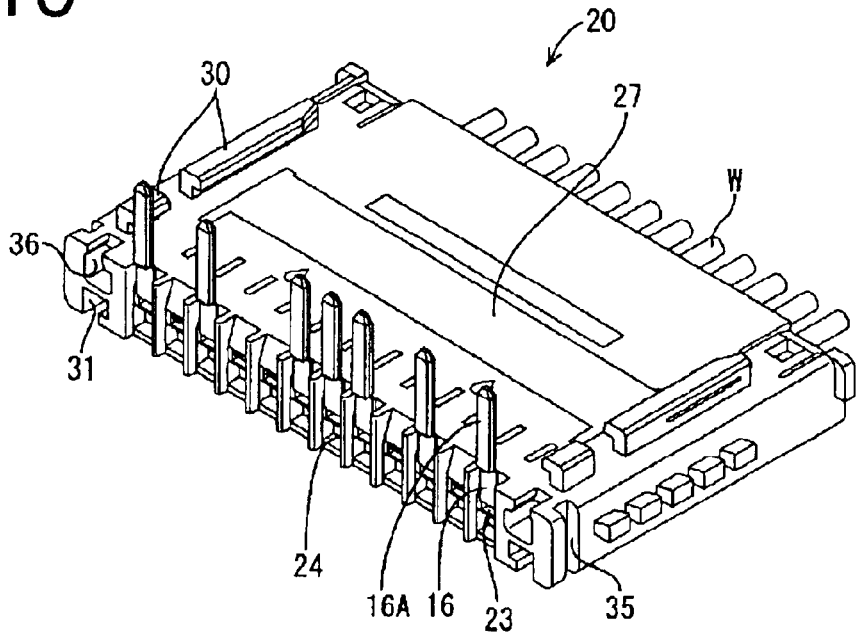
FIG. 10 is a perspective view showing a state where the terminal fittings are bent once.
Figure 11:
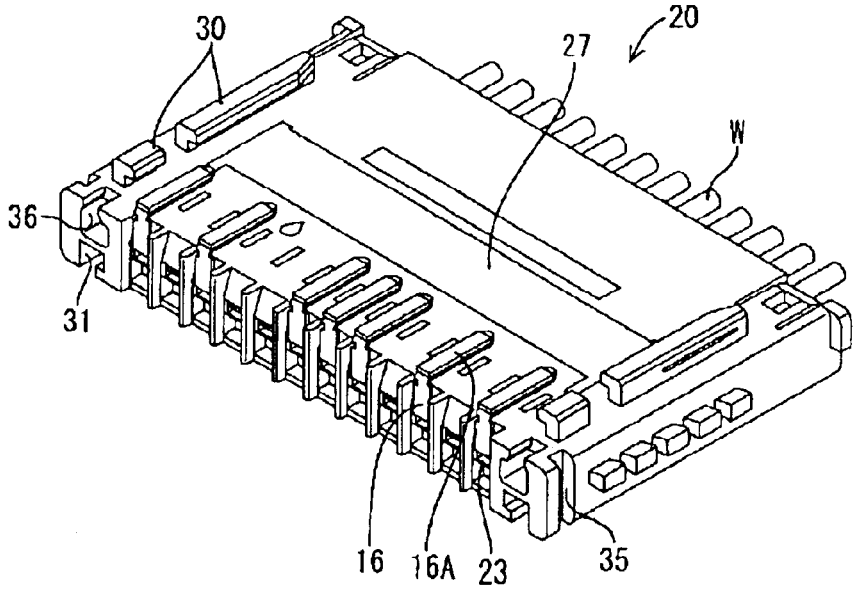
FIG. 11 is a perspective view showing a state where the terminal fittings are bent twice.

The terminal fittings 10 of the joint connector JC are accommodated in the chambers 21 of each housing 20 and have their joints 16 bent, as shown in FIG. 3, to establish electrical connections with the terminal fittings 10 in the chambers 21 of the housing 20 to be located right above. Specifically, the joints 16 are bent up at substantially right angles at their base ends located at the outlets 23, as shown in FIG. 10. The joints 16 then are bent back at the base ends of the doubly-folded portions 16A at substantially right angles, as shown in FIG. 11. Consequently, the joints 16 are folded substantially in U-shapes with the doubly folded portions 16A faced substantially back.

The housings 20 are joined successively by being placed one over another in this state. The joints 16 of the terminal fittings 10 are bent immediately before the housings 20 are placed one over another to be joined. In other words, the connector housings 20 are handled while the joints 16 of the terminal fittings 10 project forward until the connector housings 20 are placed substantially one over another to be joined after the terminal fittings 10 are accommodated in the terminal accommodating chambers 21.

A cover 60 is provided to protect the projecting joints 16. The cover 60 is made e.g. of a synthetic resin and defines a cap for mounting on the housing 20 from the front as shown in FIGS. 1 and 3. The cover 60 is dimensioned to substantially cover the housing 20 from the projecting ends of the joints 16 that project from the terminal fittings 10 to a position slightly before the rear ends of the ribs 30 as shown in FIG. 8 when the cover 60 is mounted at a proper position.

A widthwise middle portion of the rear side of the upper plate of the cover 60 is cut away by a specified distance to form an aperture 61 for exposing a portion where the retainer 27 is to be mounted.

Figure 4:
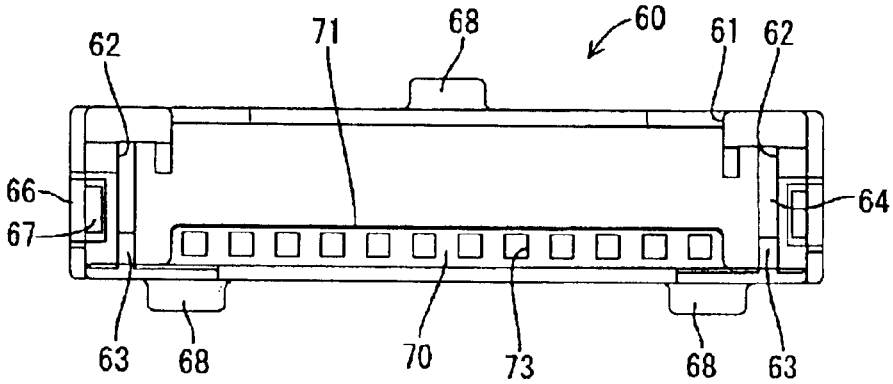
FIG. 4 is a rear view of the cover.

Side grooves 62 are formed on the inner surfaces of the left and right ends of the upper plate of the cover 60, as also shown in FIG. 4, and extend in forward and backward directions for slideably engaging the ribs 30 on the upper surface of the connector housing 20. On the other hand, rails 63 are formed on the inner surface of the left and right ends of the bottom plate of the cover 60 and extend in forward and backward directions for slideably engaging the engaging grooves 31 in the bottom surface of the housing 20. A slightly elevated abutment 64 is formed on the upper surface of the backside of each rail 63. The abutments 64 are brought against the front surface of the housing 20 to prevent the cover 60 from being pushed any further. With the cover 60 prevented from being pushed any further, the front plate of the cover 60 stays immediately before the joints 16 of the terminal fittings 10 that project from the front surface of the housing 20, as shown in FIG. 8.

Figure 5:
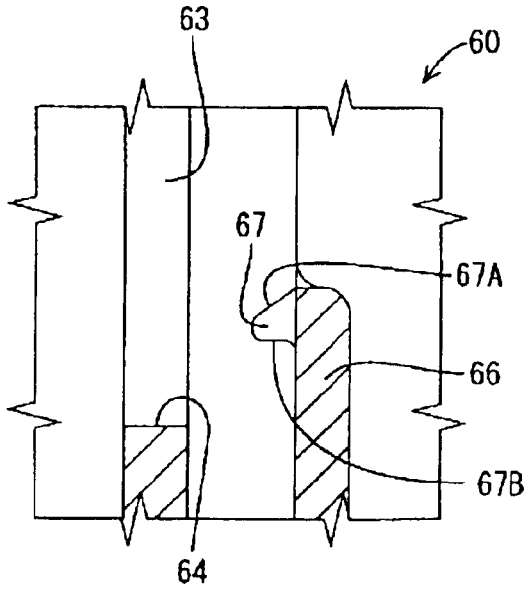
FIG. 5 is a partial enlarged plan view in section showing a portion of the cover near where a locking piece is formed.

The left and right plates of the cover 60 have substantially their back halves cut away, and two slits are formed in the cut end of each plate to form a resiliently deformable locking piece 66. A projection 67 is formed at the inner surface of the leading end of each locking piece 66 as shown in FIG. 5, and is engageable with the corresponding guide groove 35 on the side surface of the housing 20. The projection 67 has a slanted guide surface 67A facing the housing 20 and an opposite locking surface 67B at substantially a right angle to a fitting direction FD of the cover on the housing 20. With the cover 60 mounted at the proper position, the projections 67 of the locking pieces 66 reach the positions of the guide grooves 35 of the housing 20.

Protrusions 68 are formed substantially at the center of the front end of the upper plate and at the left and right ends of the front end of the bottom plate of the cover 60 to detach the cover 60 by hooking a jig or the like.

A raised portion 70 is formed substantially over the entire width on the inner surface of the front plate of the cover 60 and is raised from the bottom surface by a specified distance. The raised portion 70 extends a sufficient distance to be immediately before the housing 20 when the cover 60 is mounted at the proper position (see FIG. 8). Further, the upper surface of the raised portion 70 is immediately below the joints 16 that project from the front surface of the housing 20, and a moderately slanted guide surface 71 is formed at the upper corner of the raised portion 70 that faces the joint 16.

Figure 9:
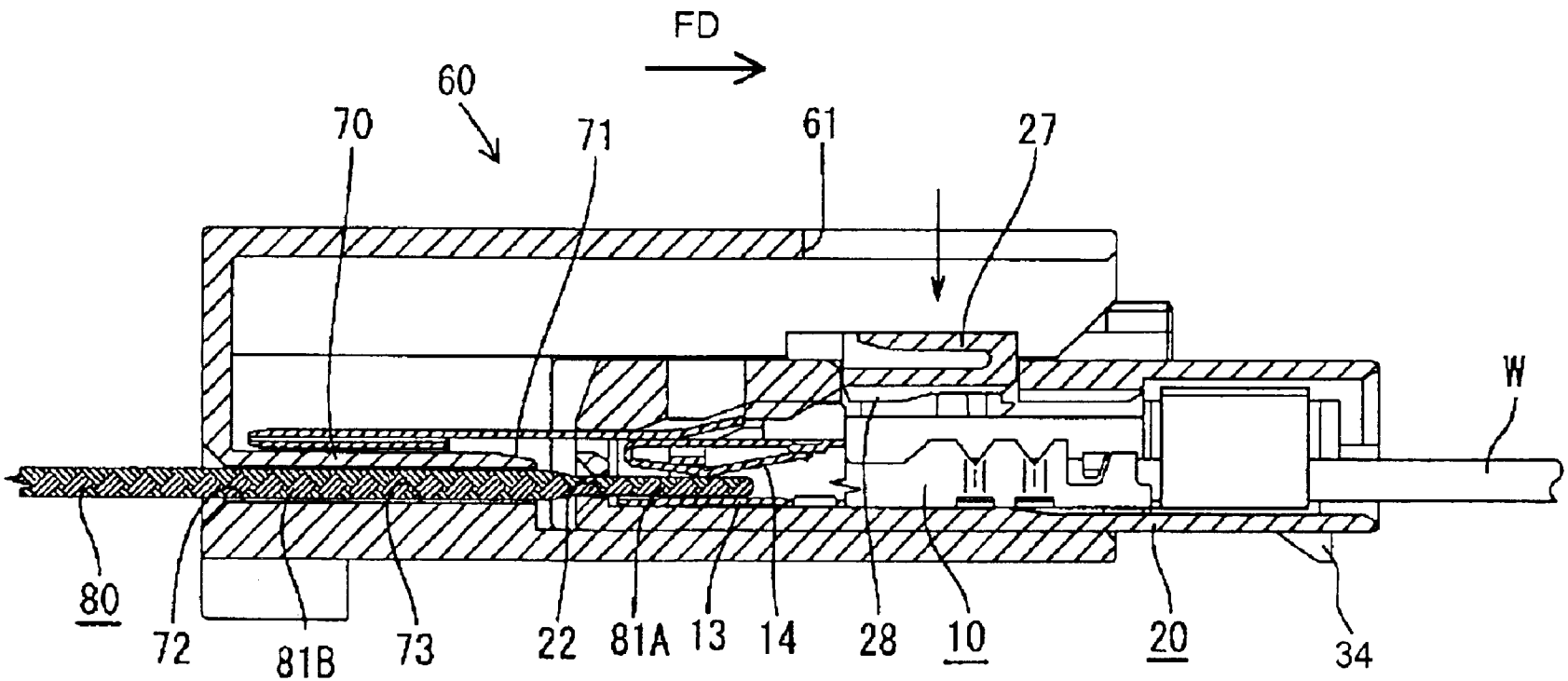
FIG. 9 is a longitudinal section showing a state during the electrical connection test.

Beveled insertion holes 72 are formed in the front surface of the raised portion 70 and insertion paths 73 are formed continuously at the back of the insertion holes 72. The respective insertion holes 72 and insertion paths 73 are formed substantially concentrically with the insertion openings 22 in the front surfaces of the respective chambers 21 of the housing 20. The insertion holes 72 and insertion paths 73 can receive probes 80 for an electrical connection test. The probe 80 is a stepped bar having a narrowed leading end 81A and a wide rear end 81B, as shown in FIGS. 8 and 9, and is connected with an unillustrated electrical connection testing circuit. The beveled insertion holes 72 perform an initial guiding function for the probe 80. The narrowed leading end 81A of the probe 80 then can enter the chamber 21 through the insertion opening 22, while the insertion paths 73 smoothly guide the widened rear end 81B of the probe 80.

The connector is assembled by initially holding the retainer 27 at the partial locking position in the housing 20. The terminal fittings 10 connected with the ends of the wires W then are inserted into the corresponding chambers 21, as indicated by an arrow in FIG. 1. The metal locks 15 fit into the locking holes 25 to partly lock the terminal fittings 10 when the terminal fittings 10 have been pushed to a specified position (see FIG. 8). At this stage, the joints 16 project forward of the housing 20 through the outlet 23 for those terminal fittings 10A that still have a joint 16.

Next, the cover 60 is mounted. The slidable grooves 62 and the rails 63 on the upper and lower sides of the cover 60 are aligned with the ribs 30 and the engaging grooves 31 on the upper and lower sides of the connector housing 20 and then the cover 60 is pushed onto the housing 20 from the front. As the cover 60 is pushed, the doubly folded portions 16A of the projecting joints 16 come to be located above the upper surface of the raised portion 70. Even if the joints 16 are inclined slightly down, they are guided toward the upper surface of the raised portion 70 by the guide surface 71.

Figure 6:
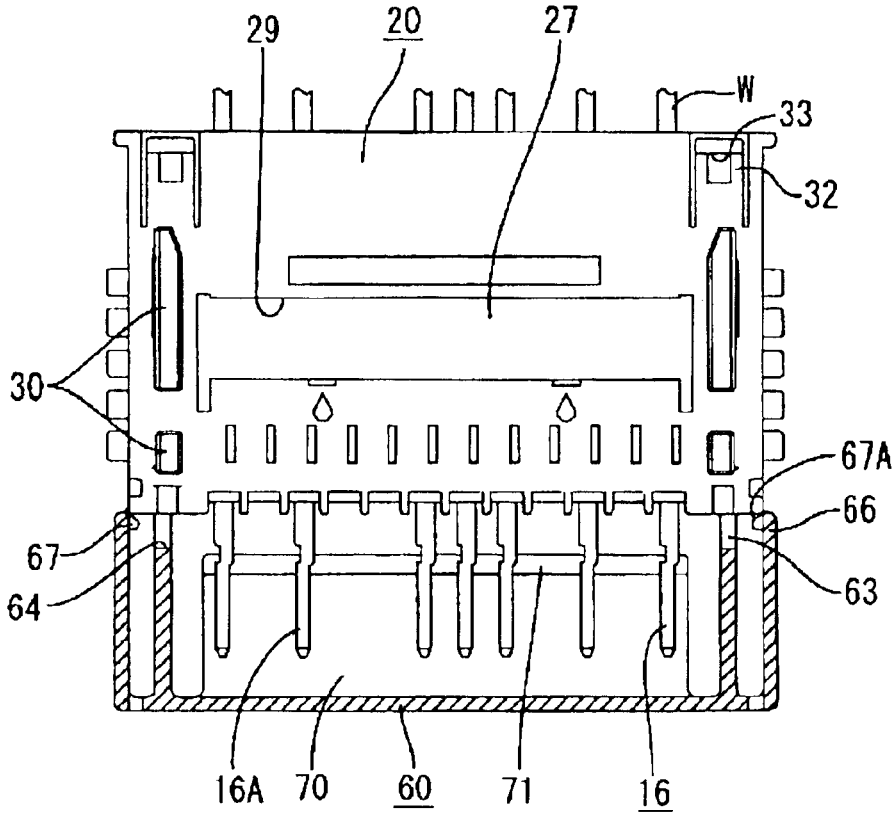
FIG. 6 is a plan view partly in section showing an intermediate stage of mounting the cover.
Figure 7:
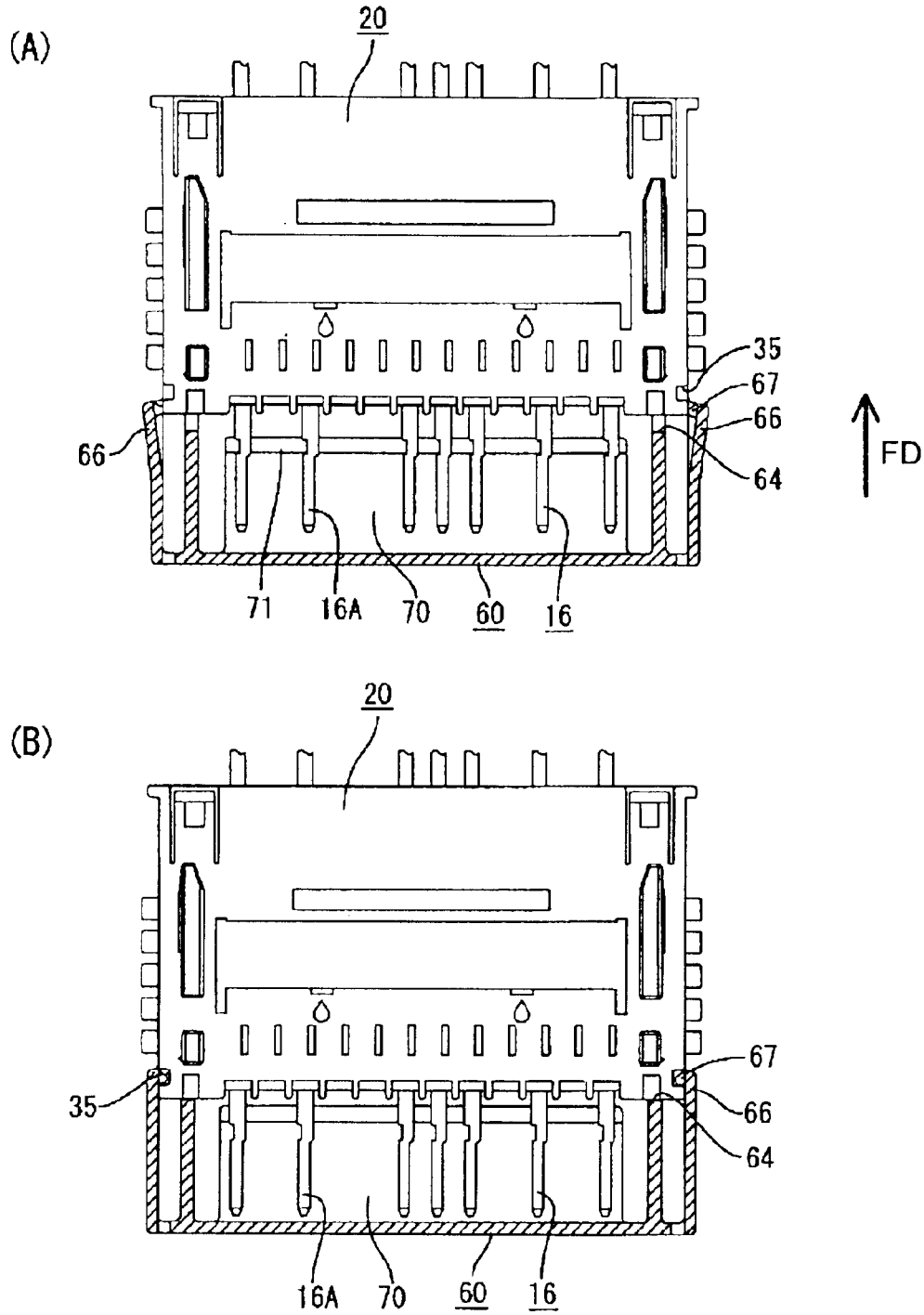
FIGS. 7A and 7B are plan views partly in section showing a final stage of mounting the cover.

The guide surfaces 67A of the projections 67 on the locking pieces 66 contact the left and right edges of the front surface of the housing 20, as shown in FIG. 6, at a final stage of pushing the cover 60. As a result, further pushing of the cover 60 in the fitting direction FD causes the locking pieces 66 to deform resiliently out, as shown in FIG. 7A. The abutments 64 then engage the front surface of the housing 20 to prevent the cover 60 from being pushed any further, and the locking pieces 66 are restored to fit the projections 67 into the guide grooves 35 in the side surfaces of the housing 20 so that the cover 60 will not come off.

The mounted cover 60 protects the joints 16 of the terminal fittings 10 that project from the front surface of the housing 20, as shown in FIG. 8.

The electrical connection test is conducted with the cover 60 mounted in this way. More particularly, the housing 20 is set in a testing device (not shown), and the probe 80 is introduced into the insertion hole 72 in the front surface of the cover 60, as shown in FIG. 8. The widened rear end 81B of the probe 80 enters the insertion path 73 and is prevented from shaking by the upper, lower, left and right walls of the insertion path 73. The narrowed leading end 81A of the probe 80 then is inserted through the insertion opening 22 in the front surface of the chamber 21 and into the terminal connecting portion 13 of the terminal fitting 10 in the corresponding chamber 21, as shown in FIG. 9, for contact with the resilient contact piece 14. A specified electrical connection test then can be conducted.

The probe 80 is pulled out after completion of the electrical connection test, and the retainer 27 is pushed through the aperture 61 in the upper plate of the cover 60 and toward the full locking position as indicated by an arrow in FIG. 9. Then, the locks 28 of the retainer 27 project into the chambers 21 to engage the engaging portions 18 of the terminal fittings 10, so that the terminal fittings 10 are locked doubly and will not come out.

The housing 20 is handled with the projecting joints 16 of the terminal fittings 10 protected by the cover 60 until the housing 20 is joined with the other housings 20.

The housings 20 are placed one over another and joined by first removing the covers 60 from the housings 20. Specifically, the locking pieces 66 are deformed by a jig or the like to disengage the projections 67 from the guide grooves 35 and the cover 60 then is pulled forward.

The joints 16 of the terminal fittings 10 projecting from the front surface of the housing 20 then are bent up at substantially right angles at their base ends, as shown in FIG. 10. The joints 16 then are bent back at substantially right angles at the base ends of the doubly folded portions 16A, as shown in FIG. 11 so that the doubly folded portions 16A face substantially backward.

The engaging grooves 31 of the upper housing 20 aligned and slidably engaged in the sliding direction SD with the ribs 30 of the lower housing 20, as shown in FIG. 12, and the housings 20 are placed substantially one over another as shown in FIG. 13. At this time, the doubly folded portions 16A of the joints 16 enter the chambers 21 through the insertion openings 22 of the upper housing 20 and are inserted into the terminal connecting portions 13 of the terminal fittings 10 in the upper housing 20 for contact with the resilient contact pieces 14. In this way, the pairs of upper and lower terminal fittings 10 are connected with each other.

The block 55 comprised of e.g. eight stages of the housings 20 is formed as shown in FIG. 14 by successively placing the housings 20 one over another to be joined in this way.

The fixing member 40 then is mounted in the inserting direction X to substantially cover the entire bottom surface of the bottom most connector housing 20 by aligning and slidably inserting the ribs 43 with and into the engaging grooves 31 of the bottom most housing 20 as shown in FIG. 14 and by fitting the projections 34 into the locking holes 45 of the locking pieces 44 as shown in FIG. 15.

Subsequently, the shutter 50 is pushed in the mounting direction Y while substantially aligning the elongated projections 52 with the lines of the guide grooves 35 formed in the side surfaces of the block 55 as shown in FIGS. 14 and 16. The shutter 50 is pushed to a specified depth where the engaging projections 54 engage the recesses 36. Then, the lock projections 47 are fitted into the lock holes 53 and, consequently, the shutter 50 is mounted to cover the front surface of the block 55 as shown in FIG. 17. In this way, the assembling of the joint connector JC is completed.

As described above, the cover 60 is mounted until the joints 16 are bent substantially after the terminal fittings 10 are accommodated into the chambers 21 of the housing 20. Thus, the joints 16 of the terminal fittings 10 projecting forward through the outlets 23 of the chambers 21 can be protected from the collision with external matter.

The cover 60 is formed with the insertion holes 72 and the insertion paths 73 for the probe 80 used for the electrical connection test. Thus, the electrical connection test can be conducted while the joints 16 are protected and before being folded. Further, the terminal fitting 10 can be reinserted easily in the case of, e.g. an erroneous insertion.

The insertion paths 73 have a sufficient length and are closely engageable with the widened portion 81B of the probe 80. Thus, the probe 80 will not shake and can be introduced precisely to the terminal connecting portion 13 of the terminal fitting 10 without striking against the joint 16.

The guide surface 71 is formed at the upper corner of the extending end of the raised portion 70. Therefore, the joints 16 can be guided to the upper surface of the raised portion 70. This enables the avoidance of problems such as the deformation of the joints 16 caused by collision with the raised portion 70 and a hindrance to the entrance of the probe 80 by the joints 16 that have entered the insertion paths 73.

The cover 60 has the aperture 61 for exposing the retainer-mounting portion. Thus, the retainer 27 can be pushed to the full locking position with the cover 60 mounted, thereby doubly locking the terminal fittings 10.

The cover 60 is mounted on the housing 20 by the resilient engagement of the locking pieces 66. Thus, the cover 60 can be locked firmly into the housing 20 and can be disengaged therefrom without plastically deforming the projections 67.

The guide grooves 35 along which the shutter 50 is slidably mounted are used as receiving portions engageable with the projections 67 of the locking pieces 66. Accordingly, the construction of the joint connector JC can be made simpler.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The projections on the locking pieces of the cover may be formed into a triangular shape having both surfaces inclined, thereby forming a so-called semi-locking structure. This enables the cover to be detached without using a jig or the like.

The assembling procedure described in the foregoing embodiment is merely an example. For example, the terminal fittings may be accommodated after the cover is mounted on the connector housing. Further, the retainer may be pushed to the full locking position before the electrical connection test is conducted using the probe that exerts a force to the terminal fitting in withdrawing direction.

Although the terminal fittings illustrated and shown in the foregoing embodiment are of the insulation-displacement type, they may be of the crimping type that are crimped into connection with the ends of the wires.

What is claimed is:

1. A cover for a joint connector having a plurality of housings, each of said housings having at least one chamber with a front opening, terminal fittings accommodated in the corresponding chambers and having joints projecting forward through the respective front opening, wherein the cover is detachably mountable on one of said housings to substantially cover the joints of the terminal fittings projecting through front openings of the chambers, the cover having a first wall substantially parallel to the joints of the respective terminal fitting and a second wall parallel to and between the joints and the first wall such that an insertion path is defined between the first and second walls, the second wall being formed with a guide surface for guiding the joints to a position outside the insertion path, the cover further being formed with at least one insertion hole providing communication to the insertion path, whereby an electrical connection testing device can be inserted through the insertion hole for electrical contact with the terminal fittings, and whereby the first and second walls prevent the electrical connection testing device from shaking in a direction normal to the first and second walls.

2. The joint cover of claim 1, wherein a third wall and a fourth wall are formed substantially continuously with each insertion hole and the insertion path for permitting the insertion of the electrical connection testing device while preventing the electrical connection testing device from shaking in a direction normal to the third and fourth walls.

3. A cover for a housing of a joint connector, said cover comprising: a front wall, a plurality of interconnected sidewalls extending rearwardly from the front wall to an open rear end, said open rear end being dimensioned for telescoped engagement on said housing, one of said sidewalls of said cover including a raised portion extending from said front end of said cover to a location between said front and rear ends, portions of said cover having said raised portion being cross-sectionally smaller than said housing for limiting the telescoped engagement of said cover onto said housing, locking means formed on at least one of said sidewalls of said cover between said raised portion and said open rear end for releasable locking with said housing, at least one insertion hole extending from the front wall and through the raised portion substantially parallel to the sidewalls, whereby the insertion hole permits insertion of a probe for electrical testing of the joint connector, and whereby said raised portion keeps said front wall spaced from said housing for protecting terminal fittings of said housing.

4. A joint connector, comprising:

a plurality of housings configured for being joined with one another;

at least one chamber extending substantially in forward and backward directions in each housing, such that said plurality of housings define a plurality of chambers, front openings extending respectively into the chambers;

terminal fittings disposed respectively in said chambers, a joints extending forward on the respective terminal fittings and projecting through the front opening of the respective chambers;

covers detachably mountable respectively on each of said housings to substantially cover the joints projecting through the front opening of the respective chambers; and retainers formed separately from said housings and said covers and mounted respectively on each of said housings for locking the terminal fittings in the respective housing, said covers being formed respectively with apertures through which the respective retainers can be manipulated.

5. The joint connector of claim 4, wherein each of said covers comprises a resilient lock releasably engageable with the corresponding housing.

6. A joint connector, comprising;

a plurality of housings configured for being joined with one another, a guide being provided at least on one side surface of each of said housings, the guides of the housings being substantially aligned when the housings are placed substantially one over another to be joined;

at least one chamber extending substantially in forward and backward directions in each housing, such that said joint connector has a plurality of chambers, front openings extending respectively into the chambers;

a terminal fitting in each of said chambers, a plurality of said terminal fittings comprising a joint extending forward on the terminal fitting and projecting respectively through the front openings of the chambers;

a cover detachably mountable on each of said housings to substantially cover the joints projecting through the front openings of the chambers; and a shutter being slideably mountable to substantially cover the front surfaces of the joined housings, and each guide defining a receiving portion for receiving the resilient lock of the corresponding cover.

7. A joint connector comprising:

a plurality of housings configured for being joined to one another;

at least one chamber extending substantially in forward and backward directions in each housing, such that said joint connector has a plurality of chambers, front openings extending respectively into the chambers;

a terminal fitting in each of said chambers, a plurality of said terminal fittings comprising a joint extending forward from the terminal connecting portion and projecting respectively through the front openings of the chambers; and covers detachably mountable respectively on each of said housings to substantially cover the joints projecting through the front openings of the chambers, wherein each of the covers comprises a front wall and a plurality of sidewalls extending rearwardly from the front wall to an open rear end, portions of each of said covers adjacent the open rear end being dimensioned for telescoped engagement onto one of said housings, one of said sidewalls of each of said covers having a raised portion extending from the front end to a location between the front and rear ends, the raised portion being dimensioned for limiting the telescoped engagement of the cover onto the housing and preventing contact between the cover and the joints.

8. The joint connector of claim 7, wherein at least one of the sidewalls comprises locking means for releasable locked engagement of the cover with the housing.

9. The joint connector of claim 8, wherein the raised portion has insertion openings extending therethrough substantially parallel to the sidewalls for accessing the terminal connecting portions of the terminal fittings with a probe.

10. The joint connector of claim 9, wherein the raised portion has a tapered rear end for guiding the joints away from the insertion openings as the cover is being mounted on the housing.

11. A method of assembling a joint connector, comprising:

providing a plurality of housings, each of said housings having at least one chamber, accommodating terminal fittings in the chambers while allowing a tab-shaped joint of at least part of the terminal fittings to project through front openings of the chambers, detachably mounting a cover on each housing to cover the joints of the terminal fittings projecting through the front openings of the chambers, inserting an electrical connection testing device into at least one insertion hole in the cover for bringing the electrical connection testing device into electrical contact with portions of the terminal fittings spaced from the respective joints thereof, performing an electrical connection test, removing the cover from the respective housing, bending the joints of the terminal fittings to project substantially backward, and joining the plurality of housings to join the joint of one terminal fitting in one of the housings with a corresponding terminal fitting of another of the housings.

* * * * *